US006321674B1

(12) United States Patent
Whitmore, III

(10) Patent No.: US 6,321,674 B1
(45) Date of Patent: Nov. 27, 2001

(54) CLEAT COMPONENT AND PADEYE COMBINATION

(76) Inventor: Willet Francis Whitmore, III, 1121 Lewis Ave., Sarasota, FL (US) 34237

( * ) Notice: Subject to any disclaimer, the term of this patent is extended or adjusted under 35 U.S.C. 154(b) by 0 days.

(21) Appl. No.: 09/514,334

(22) Filed: Feb. 28, 2000

Related U.S. Application Data

(63) Continuation-in-part of application No. 09/072,051, filed on May 5, 1998.

(51) Int. Cl.[7] ..... B63B 21/04
(52) U.S. Cl. ..... 114/218; 24/130
(58) Field of Search ..... 114/218, 219, 114/221 R, 230.1; 24/129 R, 130

(56) References Cited

U.S. PATENT DOCUMENTS

| | | | | |
|---|---|---|---|---|
| Re. 28,550 | | 9/1975 | Perkins | 114/218 |
| 105,240 | * | 7/1870 | Paget | 114/223 |
| 701,277 | | 6/1902 | Adams . | |
| 2,339,034 | | 1/1944 | Siska | 114/218 |
| 2,745,158 | * | 5/1956 | Schweigert | 24/130 |
| 2,833,240 | | 5/1958 | Semolic | 114/218 |
| 3,352,273 | | 11/1967 | Herreshoff et al. | 114/218 |
| 3,600,917 | * | 8/1971 | Krock | 70/459 |
| 3,828,714 | | 8/1974 | Perkins | 114/218 |
| 4,147,122 | | 4/1979 | Merry | 114/218 |
| 4,150,464 | * | 4/1979 | Tracy | 24/313 |
| 4,297,962 | * | 11/1981 | Johnson, Jr. | 114/218 |
| 4,344,378 | | 8/1982 | Martin | 114/218 |
| 4,352,336 | | 10/1982 | Tostado | 114/218 |
| 4,694,544 | * | 9/1987 | Chapman | 24/625 |
| 4,843,990 | * | 7/1989 | Snyder | 440/61 |
| 4,964,355 | | 10/1990 | Milewski | 114/218 |
| 5,445,482 | | 8/1995 | Davis | 114/218 |
| 5,519,959 | * | 5/1996 | Cross | 43/21.2 |
| 5,535,694 | | 7/1996 | Czipri | 114/218 |
| 6,076,237 | * | 6/2000 | Goorhouse | 24/200 |

FOREIGN PATENT DOCUMENTS

| | | | | |
|---|---|---|---|---|
| 1011231 | * | 6/1957 | (DE) | 24/129 R |
| 6225 | * | of 1887 | (GB) | 114/218 |
| 5-172189 | * | 7/1993 | (JP) | 24/130 |

* cited by examiner

*Primary Examiner*—S. Joseph Morano
*Assistant Examiner*—Ajay Vasudeva
(74) *Attorney, Agent, or Firm*—Pennie & Edmonds LLP

(57) ABSTRACT

A cleat component including a cleat body with first and second elongated cleat horns extending in substantially opposite directions. A locking member is attached to the body, protruding therefrom in a locking position. At least a receivable one of the body and the locking member is receivable in an opening in a bale of a padeye. The body is mountable to the bale while the locking member is attached to the body. The body is also lockable to the bale when the receivable one is received in the bale with the locking member in the locking position. The component and padeye provide a cleat when locked to each other.

16 Claims, 9 Drawing Sheets

CLEAT COMPONENT AND PADEYE COMBINATION

This is a continuation-in-part of Application Ser. No. 09/072,051, filed May 5, 1998, currently pending.

FIELD OF THE INVENTION

The invention relates to a cleat component that is lockable to a padeye to provide a cleat. More particularly, the invention is related to a cleat component that is mountable and lockable to a padeye while a locking member is attached to a body of the component, protruding therefrom in a locking position.

BACKGROUND OF THE INVENTION

Sailboats typically employ horned cleats which permit lines, including running rigging such as a halyard, to be tied and secured quickly. Horned cleats generally have two horns extending in opposite directions from each other. The cleats are fixed to the boat, often on the walking surface of the deck, with the horns elevated from the surface. A line can be rapidly tied to the cleat by wrapping the line around the cleat beneath the horns and securing the line with a clove hitch, in which loop of the line is twisted and secured around one of the horns, forming a figure eight.

As typical cleats often protrude from the deck in high traffic areas, the cleats present a hazard as crew can easily stub their toes or trip, or the cleat can catch a sail, tearing it if the wind is strong. Several solutions to this problem are known. For instance, spring loaded, retractable cleats, such as taught in U.S. Pat. No. 5,535,694, are known that are depressible to a position in which they are flush with the deck. Folding cleats are also known, as taught in U.S. Pat. No. 4,964,355, which fold to a position flush with the deck.

U.S. Pat. No. 2,339,034 teaches a mooring bit with a grooved pin that fits into a lateral opening in a body that is held firmly to a sailboat deck. The body is rounded with sloped sides and has a rounded stop member which is spring biased into the groove of the pin such that the pin may be snapped into place in the body. To render the mooring bit non-fouling, the pin can be pulled out from the opening, and sheets and lines passing across the body will not be caught on the rounded body contour. Once the pin is removed, however, the lines can no longer be attached effectively to the body because the disclosed body opening is narrow and has sharp edges that would tend to fray a line.

U.S. Pat. No. 4,352,336 teaches an adjustable cleat which is rockable with respect to a base that is secured to a boat deck. Flanges of the cleat extend downwardly about a boss of the base. A capscrew extends through the flanges and the boss to permit the cleat to rock thereabout. Similarly to the '034 patent, if the cleat were removed from the base, the remaining hole would not provide an effective structure around which to tie a line. In addition, as the cleat is not easily separable from or replaceable on the base.

In some sailboats, padeyes have replaced horned cleats. Typically, padeyes are made from hardened steel and have a base that is boltable to a boat deck and which is fixed to a semiannular bale with a rounded cross section to prevent snagging a line that passes across the padeye, and to prevent fraying a line passed through the bale. Since padeyes lack horns, they are smaller obstacles to crew moving about the deck when compared to horned cleats, reducing the risk of tripping or toe stubbing.

Lacking horns, however, lines cannot be tied to padeyes as quickly as to horned cleats. An end or a portion of a line must by passed through the opening in the bale in order to secure the line. Alternatively, a shackle, such as a snap shackle, can be spliced to the line to permit a more rapid attachment to the padeye, albeit by foregoing the ability to vary the position along the line to be secured.

Padeyes are normally positioned at the bow and stern of sailboats, and centrally along the sides of the deck. It is desirable to have horned cleats at these locations when a rapid line tying is required, as loads of more than 1000 lbs can be created on rough days in 35–50 ft. sailboats. Thus, a cleat component is needed that is readily attachable to and detachable from a padeye to provide a horned cleat.

SUMMARY OF THE INVENTION

The invention relates to a cleat component that is attachable to a standard padeye to provide a cleat. The invention is also related to the combination of the component and the cleat. The component includes a cleat body with first and second elongated cleat horns that extend in substantially opposite directions. A locking member is attached to the body and protrudes therefrom in a locking position. At least one of the body and the locking member is receivable in an opening in the padeye bale. The body is mountable to the bole while the locking member is attached to the body, and the body is lockable to the bale when the locking member is in the locking position. Together, the padeye and attached cleat component provide a readily available cleat around which a line may be tied rapidly.

In a preferred embodiment, the locking member is mounted to the body for movement from an unlocked position to the locking position. The component is separable from the bale when the locking member is in the unlocked position. Less than a full rotation of the locking member with respect to the body is required to move the locking member from the unlocked to the locking position. Also, to keep the body from excessively twisting axially when locked to the padeye, a base surface of the body has edges spaced from each other to limit any such axial rotation.

The locking member preferably has an end exposed for abutting a line tied around the component and the padeye between the horns and a mounting surface to which the padeye is attached. The line thus retains the locking member in the locking position.

In a preferred embodiment, the first horn is receivable through the bale. The body includes a recessed portion disposed between the first and second horns and configured for receiving the bale. The locking member is configured and dimensioned for displacing the recessed portion of the body against the bale when in the locking position to retain the first horn in attachment with the bale. In this embodiment, the locking member is movable through the bale between the body and the padeye, from the unlocked to the locking position. The locking member has a wedge shape that tapers towards an end of the first horn and is configured for variably biasing the first horn against the bale. The first horn has a first bottom edge, at least a portion of which is locatable closer to the mounting surface than the bottom edge of the second horn. This permits a line to wedge the first horn upwardly against the bale.

In a similar embodiment, a spring is disposed for biasing the locking member with respect to the body towards the locking or unlocked positions. The body may be pressed against the locking member to unlock the body from the bale.

Suitable manners of mounting the locking member to the body include mounting the locking member slidably or rotatably for movement between the locking and unlocked positions. The locking member may also be fixed in the locking position. In one embodiment, the locking member is fixed protruding from the body adjacent the first horn by a distance sufficient to lock the body to the padeye in snapfit association therewith when the first horn and the locking member are biased through the bale.

In some embodiments, the locking member and the body are securable around a side of the bale when the locking member is in the locking position. For instance, in one embodiment, the first end is receivable through the bale, and the locking member is positionable around a leg of the bale in the locking position. In other embodiments, the body defines a slit configured to receive the bale, and the locking member in the locking position is receivable in the bale. In some embodiments, the locking member is fixable to the body in the locking position.

In one embodiment, the body is pivoted between the horns. The locking portion includes a first latch fixed to the first horn and a second latch fixed to the second horn. The latches are in the locking position when the horns are pivoted away from each other. The locking portion includes a first horn complement fixed to the second latch and disposed adjacent and in parallel with the first horn when the latches are in the locking position. A line that is clove hitched around the horn and horn complement helps keep the locking member in the locking position.

DETAILED DESCRIPTION OF THE PREFERRED EMBODIMENTS

Figure 1:
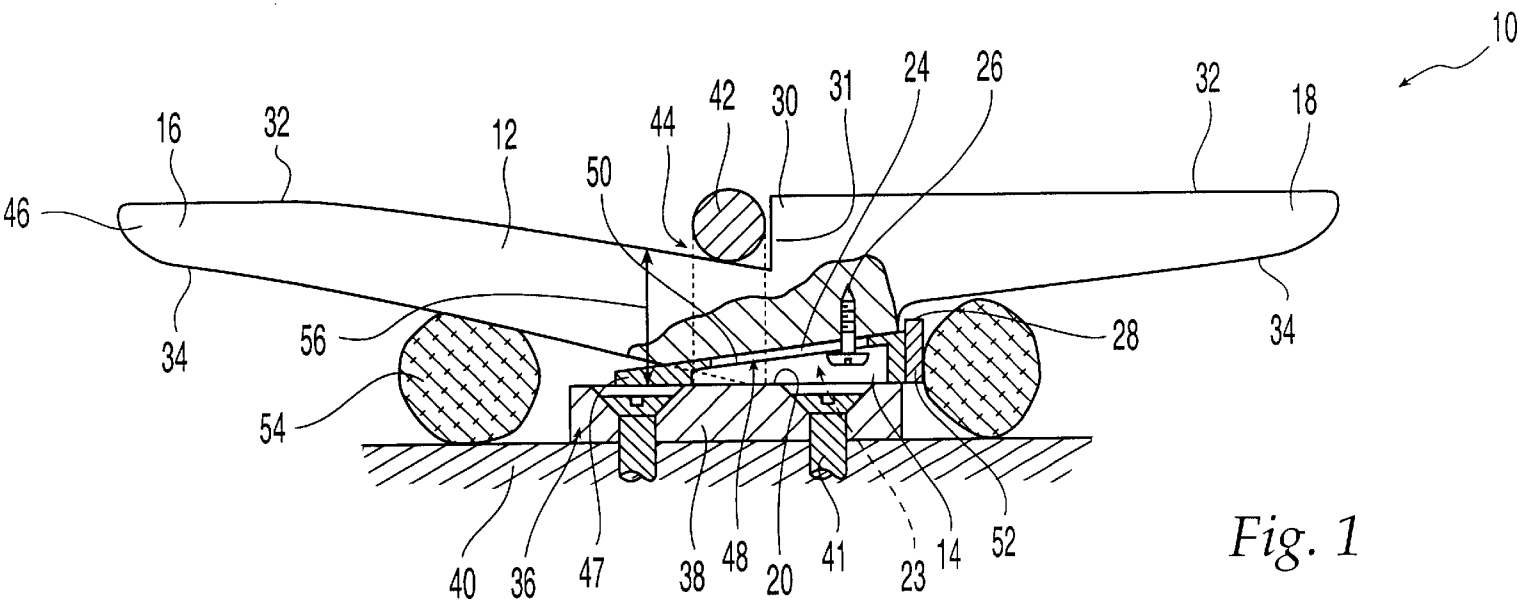
FIG. 1 is a cross-sectional side view of the preferred embodiment of a cleat and padeye.
Figure 2:
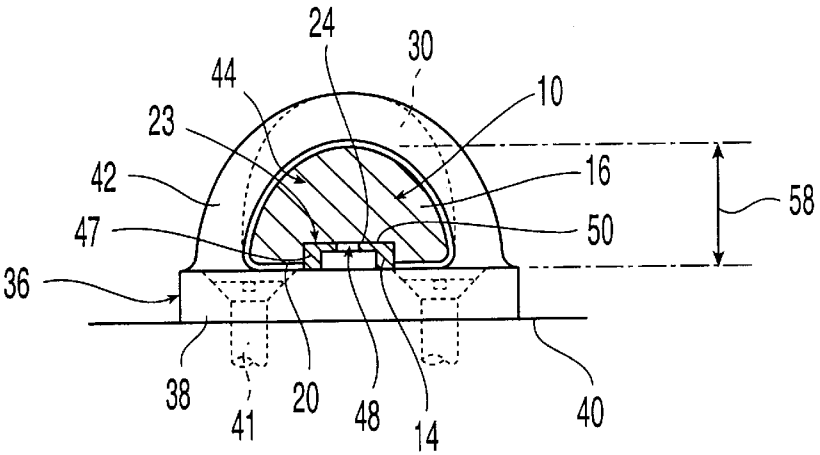
FIG. 2 is a cross-sectional end view of the preferred embodiment.
Figure 3:
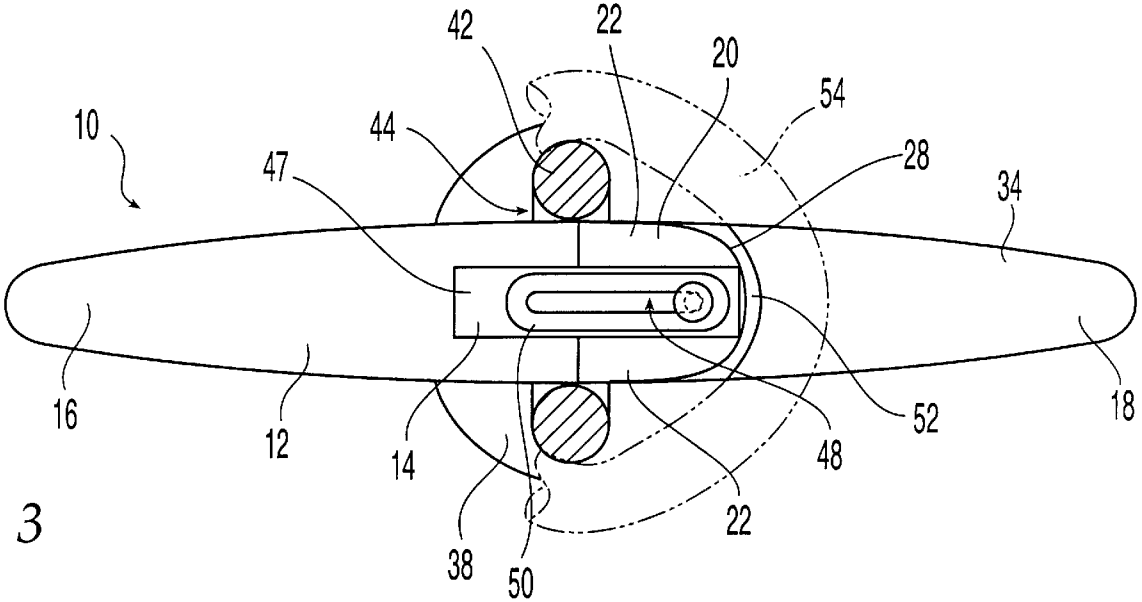
FIG. 3 is a cross-sectional bottom view of the preferred embodiment.

Referring to FIGS. 1–3, a cleat component 10, preferably a cleat head, is locked to padeye 36. The padeye 36 has a flat base 38, which is securely fastened to a sailboat deck 40 with fasteners 41. A semiannular bale 42 extends upwardly from the padeye base 38, defining a bale opening 44. The bale 42 preferably has a rounded cross-section to prevent chafing or fraying a line received therethrough. In this description, the terms vertical and horizontal are used with respect to a padeye 36 mounted to a horizontal surface. It will be understood, however, that this orientations other than the preferred orientation shown are employable.

The cleat component 10 includes a cleat body 12 and a locking member 14. The cleat body 12 has first and second elongated cleat horns 16 and 18, which extend in substantially opposite directions. The first horn 16 is receivable through the bale 42 and is shown received therethrough.

The body 12 also has a stop portion 30, which is dimensioned larger than the bale opening 44 and with a larger cross-section than the first horn 16. The stop 30 extends upwardly between the first and second horns 16 and 18, forming a concave portion 31 of the body 12 and preventing reception of the body 12 through the bale 42 past the stop 30. Thus, the second horn 18, positioned opposite the stop 30 from the first horn 16, is not receivable through the bale opening 44 when the first horn 16 is inserted therein.

The first and second horns 16 and 18 have top and bottom edges 32 and 34, the bottom edges 34 facing towards the padeye base 38 and the boat deck 40 to which the padeye 36 is secured. When the body 12 is locked to the padeye 36, both the top and bottom edges 32 and 34 of the first horn 16 are oriented at a greater angle from the horizontal, and thus from the padeye base 38, than the top and bottom edges 32 and 34, respectively, of the second horn 18. The bottom edge 34 of the first horn 16 is disposed lower, and closer to the deck 40, than the bottom edge 34 of the second horn 18.

The body 12 has a preferably flat base 20 with lateral edges 22 spaced from each other to stabilize the body 12 against the padeye base 38, limiting axial rotation of the body 12. Preferably, the lateral edges 22 are spaced by about the distance remaining between the sides of the bale 42 at the padeye base 38. Between edges 22, the body 12 has a channel 23 with a recessed ramp 24 from which protrudes a guide 26, which is preferably a screw. The head of the screw has a flat base which remains spaced from the body 12. The ramp 24 preferably extends longitudinally completely across the base 20, from adjacent the first horn 16, where the recessed ramp 24 is shallowest, to adjacent the second horn 18, where the recessed ramp 24 is deepest. The body 12 preferably has a substantially vertical wall 28 which is rounded in the horizontal direction.

The locking member 14 is attached to the body 12 within channel 23 and against the recessed ramp 24. The locking member 14 preferably has a wedge 47 that tapers vertically towards the end 46 of the first horn 16 for variably elevating the body 12 and biasing the first horn 16 and concave portion 31 against the top of the bale 42. The wedge 47 may be replaced, however, with a member with parallel walls. A slit 48 is defined through a roof 50 of the locking member 14. The guide 26 extends through the slit 48, mounting the locking member 14 to the body, while permitting the locking member 14 to slide through the bale 42 between the locking position shown and an unlocked position, substantially in parallel with the first horn 16.

The locking member 14 also has a manipulable end 52 attached to the broad end of the wedge 47. The manipulable end 52 is wider than the channel 23 to limit the forward travel of the locking member 14 towards the end 46 of the first horn 16 when the manipulable end 52 contacts the back wall 28 of the body 12. The manipulable end 52 is also curved around the base 20 of the body 12, as shown in FIG. 3. This provides a curved surface for a line 54 to be tied around. Also, line 54 retains the locking member 14 in the locking position as the line 54 is tied against the manipulable end 52, limiting backward travel of the manipulable end 52 and biasing the locking member 14 deeper into the channel 23. Also, as the bottom edge 34 of the first horn 16 extends lower than the bottom edge 34 of the second horn 18, a line 54 of sufficient size wrapped about the cleat component 10 and padeye 36 combination can be wedged against the first horn 16, further elevating the first horn 16 and producing a more secure locking of the body 12 to the padeye 36.

In the locking position shown, the locking member 14 protrudes from the body 12 and wedges the first horn 16 against the bale 42, elevating the concave portion 31 against the bale 42 to prevent withdrawal of the first horn 16 from the bale 42. The body 12 is thus retained with the bale 42 positioned in the concave portion 31. Because the locking member 14 elevates the concave portion 31 against the bale 42, it increases a height 56 defined between the top edge 32 of the first horn 16 and the bottom of the locking member 14. The height 56 is greater than the height 58 of the bale opening 44, effectively creating a wedge formed by the first horn 16 and the locking member 14. When locked to the padeye 36, the combination of the cleat head 10 and the padeye 36 provide a horned cleat, secured to the sailboat deck 40.

Figure 4:
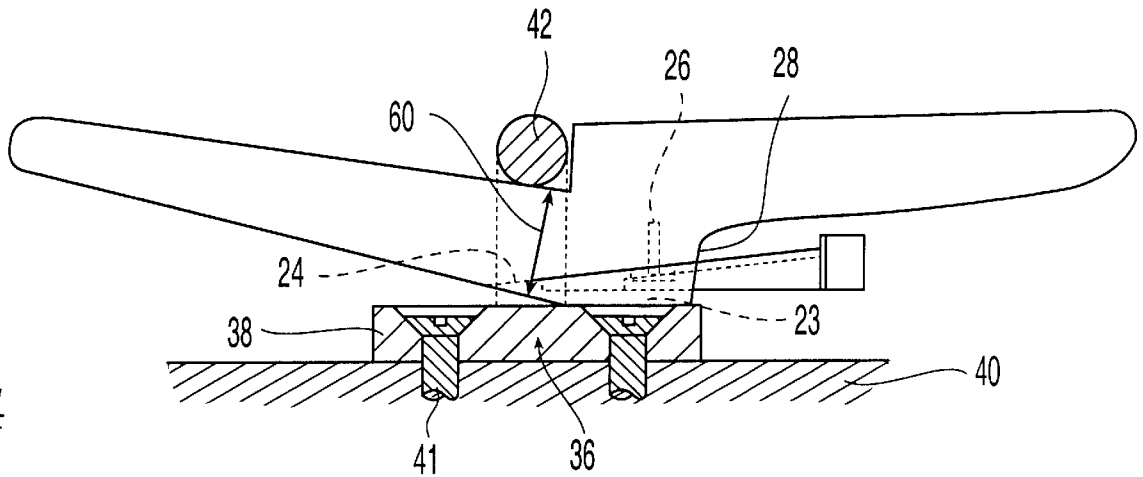
FIG. 4 is a cross-sectional side view of the preferred embodiment with a locking member in an unlocked position.

Referring to FIG. 4, the locking member 14 has been slid back along the recessed ramp 24 through the bale 42 to the unlocked position and has released the first horn 16 from its wedging against the bale 42. The height 60 of the first horn 16 is less than the height 58 of the bale opening 44. The body 12 can now be rotated counterclockwise in the figure to withdraw the first horn 16 from the bale 42.

Figure 5:
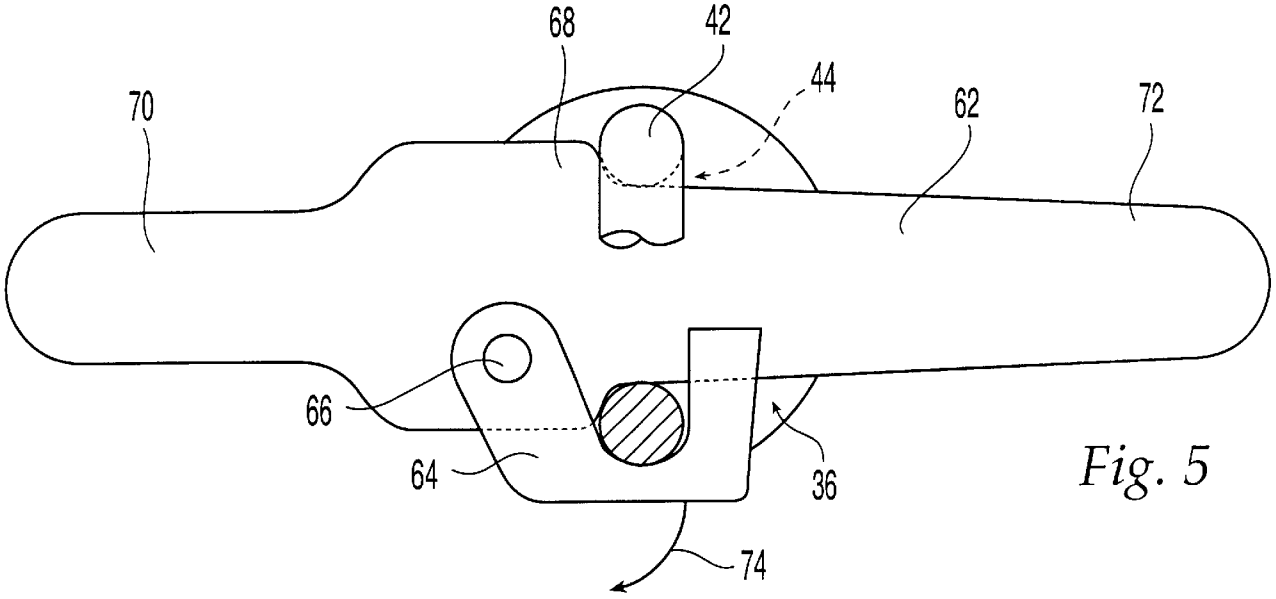
FIGS. 5–7 are top views of alternative embodiments of the invention.

FIGS. 5–10 show alternative embodiments in which the locking member is a latch that is rotatably mounted to the body. In the embodiment of FIG. 5, locking member 64 includes a latch 64 mounted to body 62 rotatably about pin 66. The body 62 includes a stop 68 extending horizontally from second horn 70 adjacent first horn 72. The first horn 72 is receivable through the bale 42. The stop 68, on the other hand, is dimensioned larger than the first horn 72 and than the bale opening 44 to prevent further reception of the body 62 through the bale 42 past the stop 68.

The locking member 64 is shown in a locking position, secured around a side of the bale 42. The body 62 is locked to the padeye 36 with the bale 42 caught between the locking member 64 and the stop 68. The locking member 64 is also rotatable in the direction of arrow 74 to an unlocked position to release the bale 42.

Figure 6:
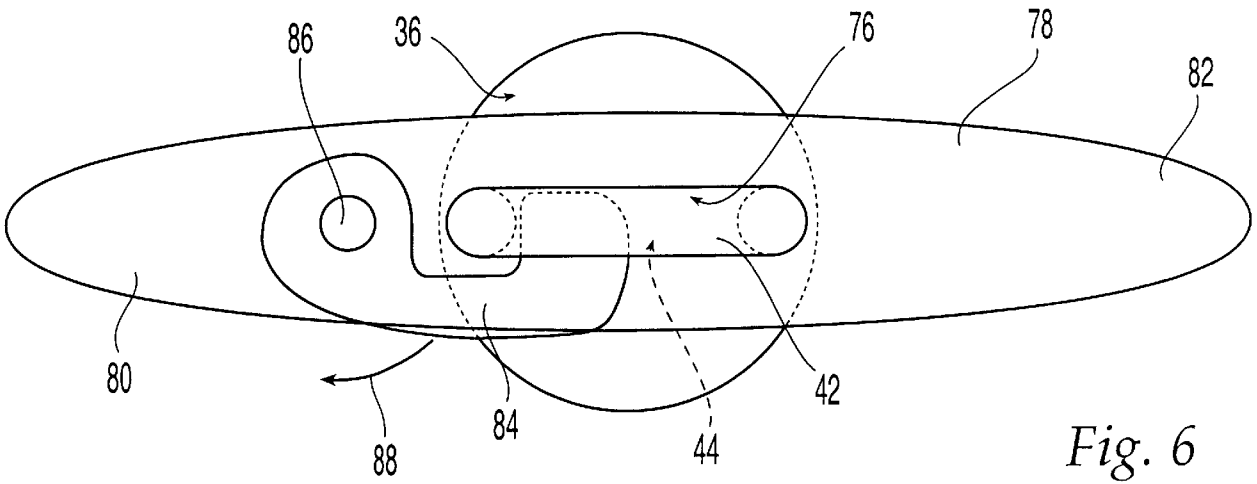

The embodiment of FIG. 6 defines a slit 76 through body 78 between the first and second horns 80 and 82. The slit 76 is dimensioned to transversely receive the bale 42. A locking member 84 is rotatably mounted to the body 78 about pin 86. The locking member 84 is shown in a locking position, received within the bale opening 44. With the locking member 84 in this position, the locking member 84 prevents the body 78 from being lifted from the padeye 36 and separated from the bale 42. The locking member 84 is rotatable in the direction of arrow 88 towards an unlocked position to release the body 78 from the padeye 36.

Figure 7:
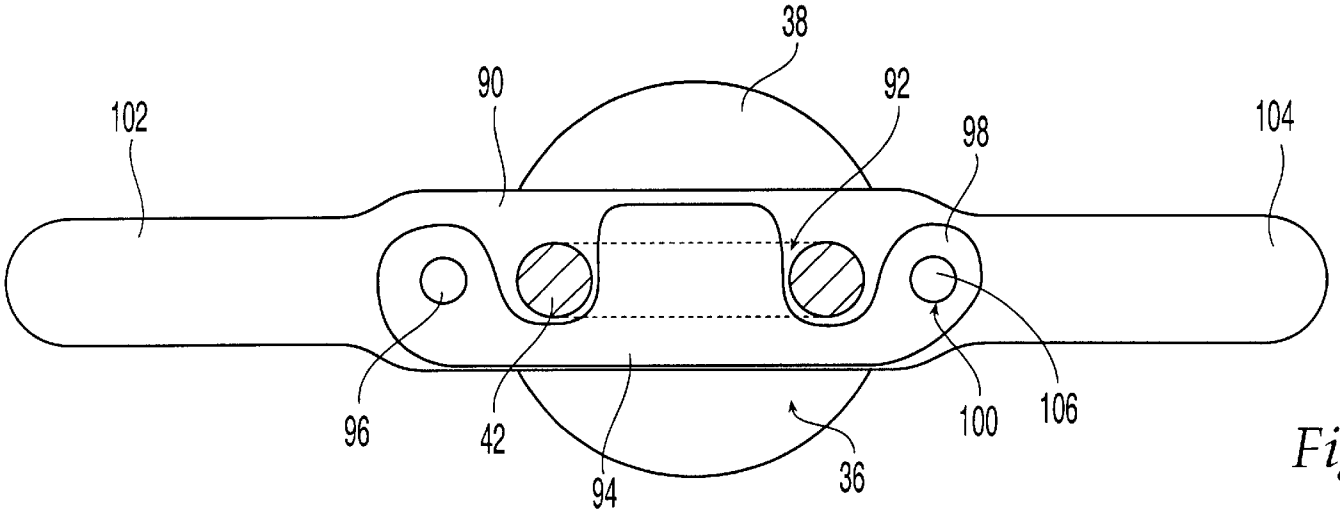
Figure 8:
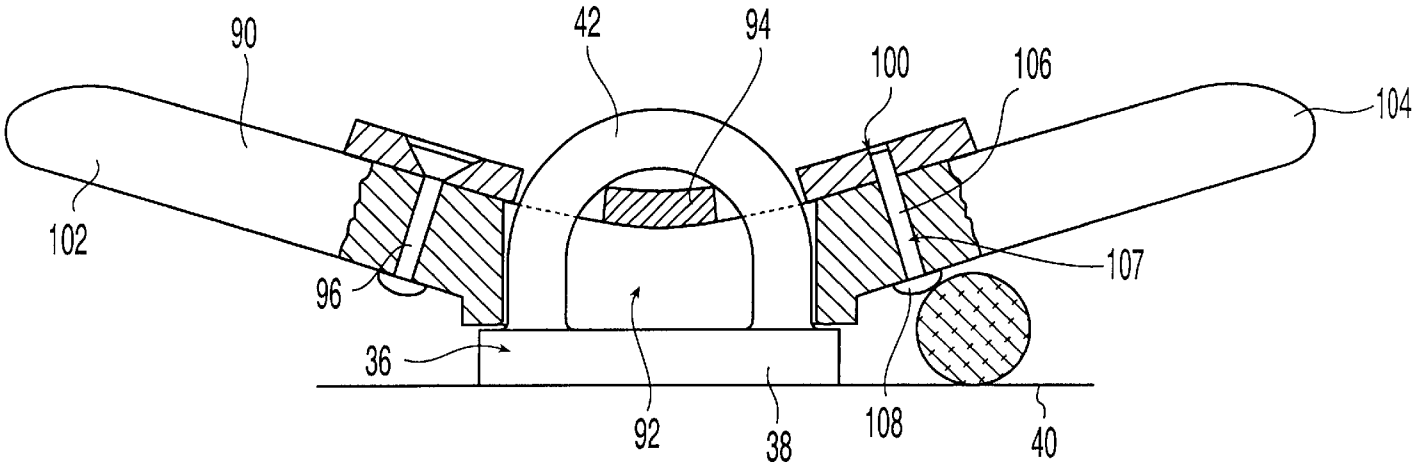
FIG. 8 is a cross-sectional side view of the embodiment of FIG. 7.

FIGS. 7 and 8 show an embodiment similar to the embodiment of FIG. 6, with a body 90 that has a slit 92 for receiving the bale 42. Locking member 94 is shown in a locking position with a portion received within the bale 42, between the bale 42 and the body 90. The locking member 94 is rotatably mounted to the body 90 about pivot pin 96, which is secured to both the locking member 94 and the body 90. The locking member 90 additionally has a fixable portion 98 that defines a hole 100. Where the pivot pin 96 is disposed in the first horn 102, the hole 100 is preferably disposed in the second horn 104, on an opposite side of the bale 42. A fixing pin 106 is received simultaneously through a bore 107 in the body 90 and the hole 100, fixing the locking member 94 in the locking position. The fixing pin 106 has a head 108 which is not receivable through the bore 107 and which remains below the second horn 104. When a line 54 is tied about the base of the resulting cleat, the line 54 abuts the fixing pin 106, helping retain the fixing pin 106 in the position shown.

Figure 9:
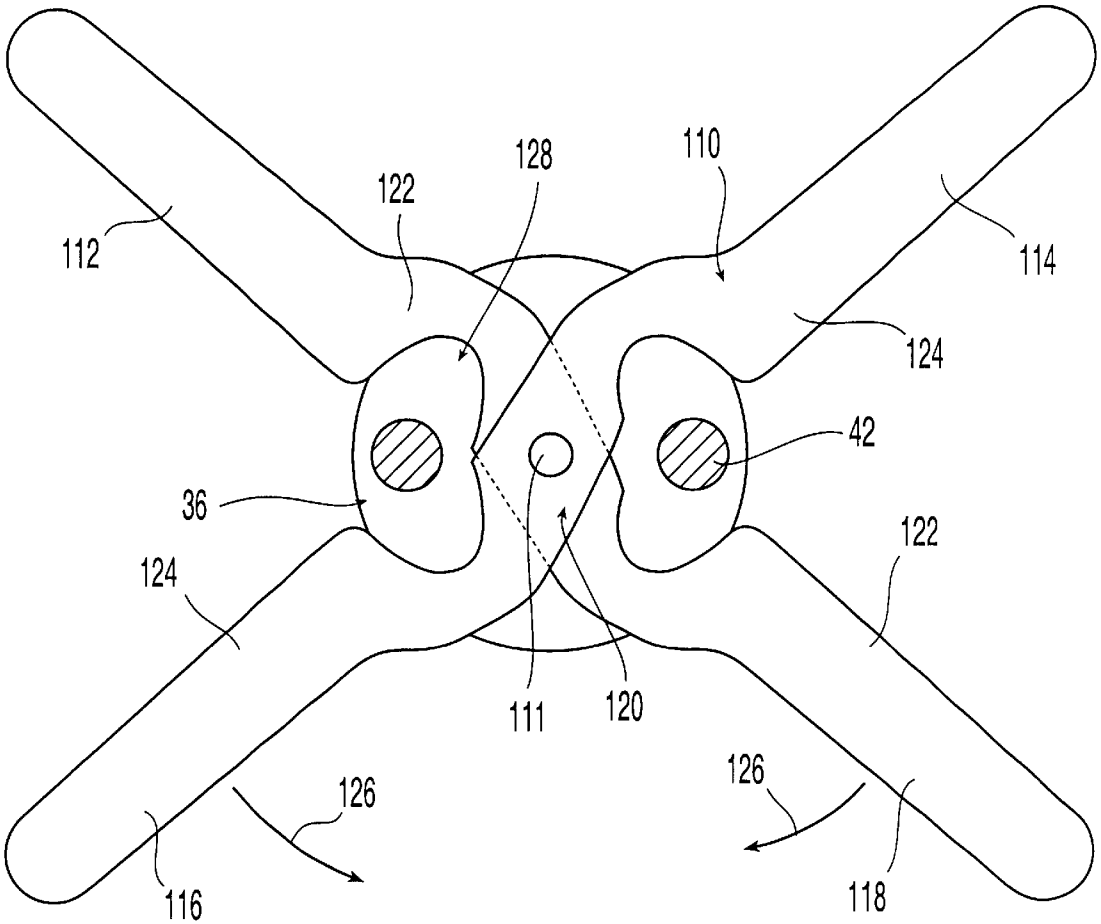
FIG. 9 is a top view of another embodiment of the invention with a locking member in an unlocked position.

Referring to FIG. 9, body 110 is pivoted about pin 111 between first and second horns 112 and 114. Locking portion 120 first and second latches 122 and 124 fixed respectively to the first and second horns 112 and 114. The latches define locking recesses 128 configured to receive a leg of the bale 42. A second horn complement 118 is fixed to the first latch 122 on an opposite side from the first horn 112. A first horn complement 116 is fixed to the second latch 124 on an opposite side from the second horn 114.

The first and second horn complements 116 and 118 are receivable through the bale 42 when the body 10 is pivoted in the direction of arrows 126, placing the locking member 120 in an unlocked position with the horns 112 and 114 and the horn compliments 116 and 118 substantially in parallel, preferably overlapping each other.

Figure 10:
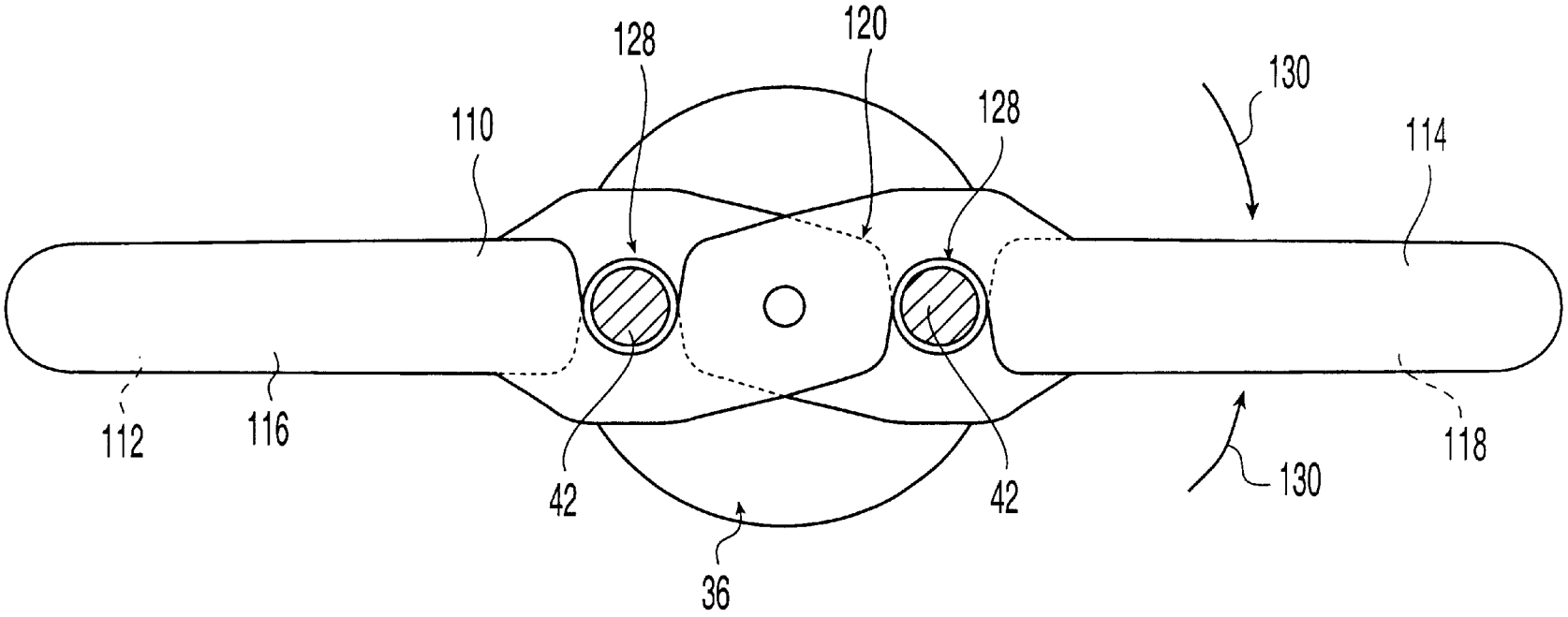
FIG. 10 is a top view of the embodiment of FIG. 9 with the locking member in a locking position.

Referring to FIG. 10, the body 110 and locking portion 120 have been rotated in the direction of arrows 130 to the locking position shown, with the horns 112 an 114 pivoted away from each other. Legs of the bale 42 are received within the recesses 128, the locking member 120 and the body 110 extending around the bale 42 legs. The first horn 112 and first horn complement 116 are parallel and overlapping. Also, the second horn 114 and second horn complement 118 are parallel and overlapping. A line tied around the base of the body 110 and locking member 120 will retain the locking member 120 in the locking position. A clove-hitched line that is looped around at least one of the horn and horn complement pairs further retains the locking member 120 in the locking position.

Figure 11:
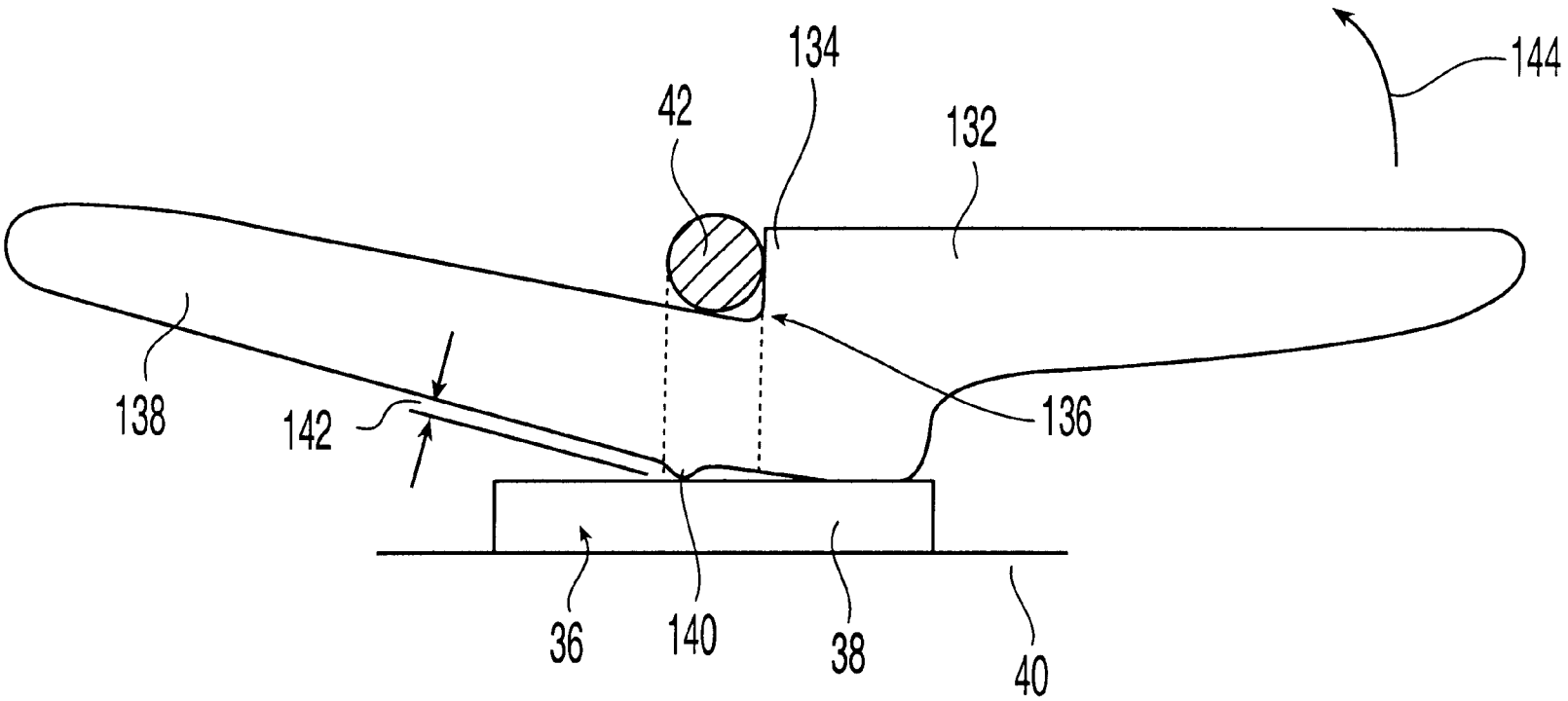
FIG. 11 is a side view of an additional embodiment of the invention.

Referring to FIG. 11, body 132 includes a stop 134 forming a concave portion 136 between first horn 138 and stop 134. The stop 134 is not receivable through the bale 42. The locking member is a protrusion 140 that protrudes adjacent the first horn 138 by a distance 142, sufficient to lock the body 132 to the padeye 36 in snap-fit association therewith when the protrusion 140 is biased through the bale 42 along with the first horn 138.

In this embodiment, the protrusion 140 is constantly in the locking position shown with respect to the body 132. The protrusion 140 is preferably made from a resilient material, such as a fiber composite, permitting sufficient deformation to permit engagement and disengagement of the body 132 with the padeye 36. To unlock the body 132 from the padeye 36, the body 132 is rotated relative to the padeye 36 in the direction of arrow 144.

Figure 12:
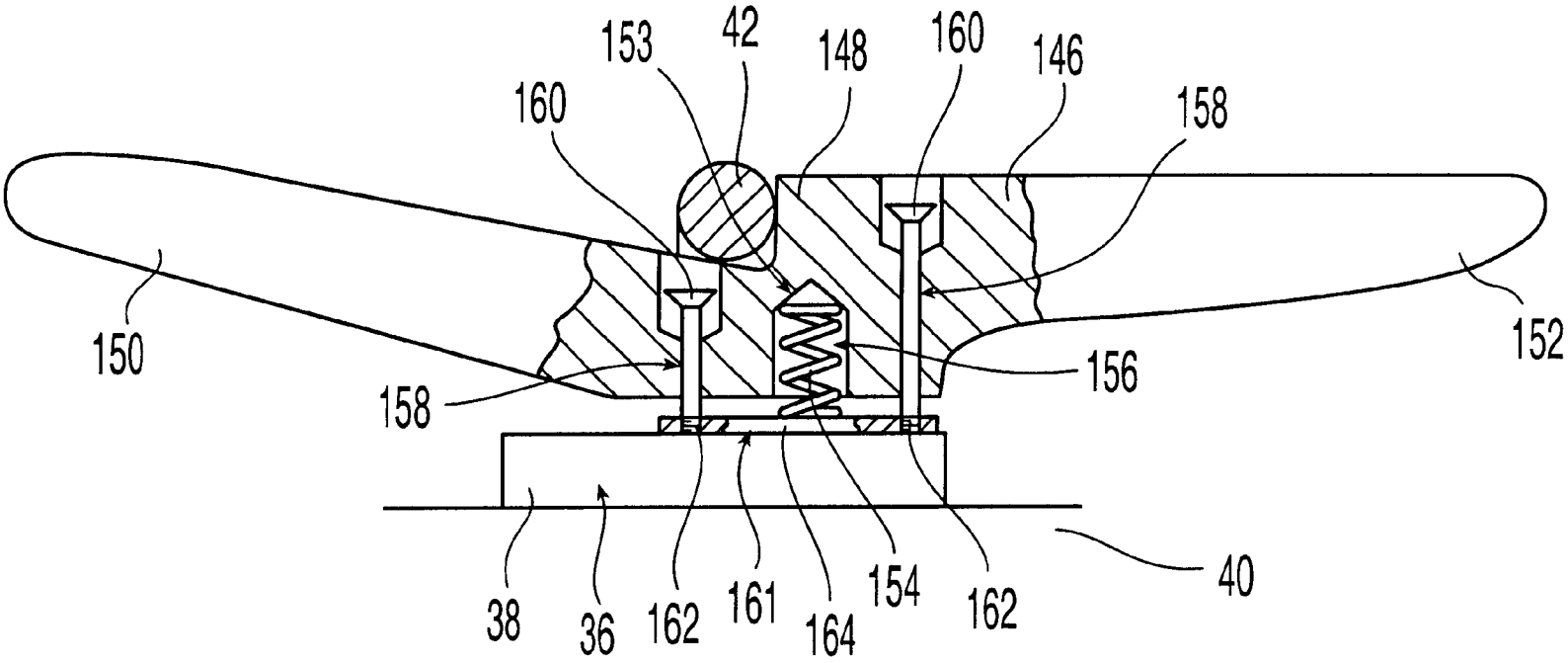
FIG. 12 is a side view of another embodiment with a spring loaded locking member.

Referring to FIG. 12, body 146 has a stop portion 148 disposed between first and second horns 150 and 152, forming a concave portion 153 adjacent thereto. A compression spring 154 is disposed in a blind bore 156, which opens to the base of the body 146. The body 146 also defines guide bores 158 in which are fitted guides 160 of locking member 161. The guides 160 have heads that are wider than the guide bores 158 and are not receivable therethrough. The guides 160 have threaded ends 162 that are fastened to a locking member plate 164, positioned adjacent the base of the body 146. Spring 154 biases the plate 164 downwardly away from the body 146, preferably in a generally radial direction with respect to the horns, and guides 160 limit the downwardly displacement of the plate 164.

The body 146 is engageable in the bale 42 by inserting the first horn 150 through the bale 42 and pressing the body downwardly, against the plate 164, retracting the plate 164 towards the body 146. When the body 146 reaches the position shown, the spring 154 biases the body upwardly against the bale 42, securing the body 146 to the bale 42, with the bale 42 received in the concave portion 153.

Figure 13:
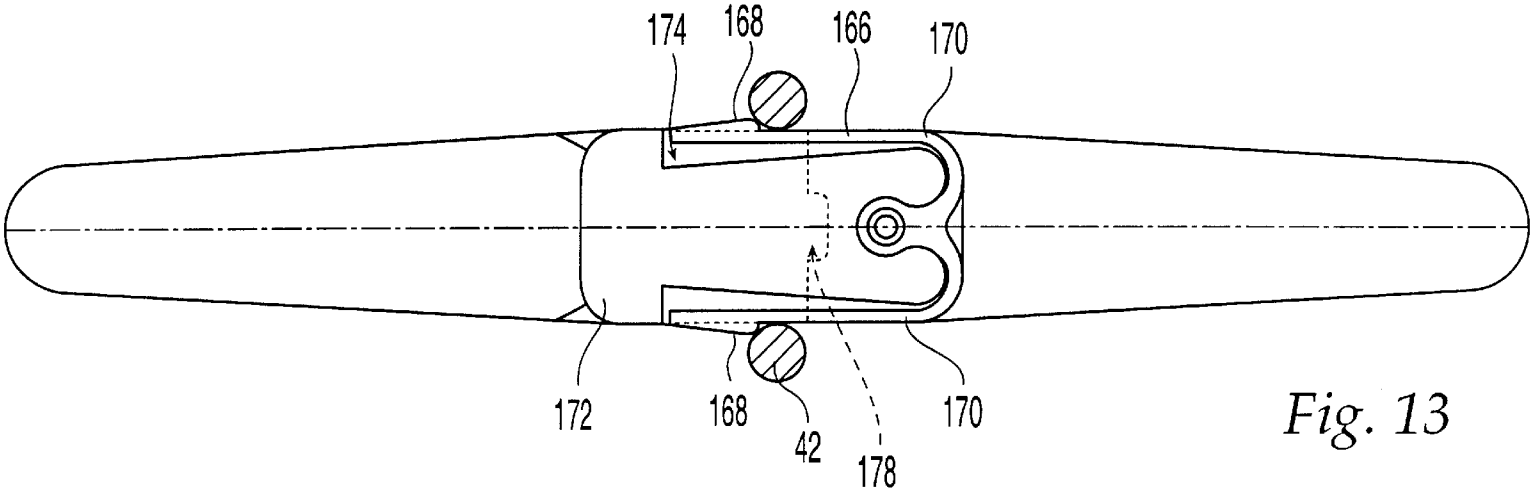
FIG. 13 is a top view of another embodiment of the invention with two locking members in a locking position.
Figure 14:
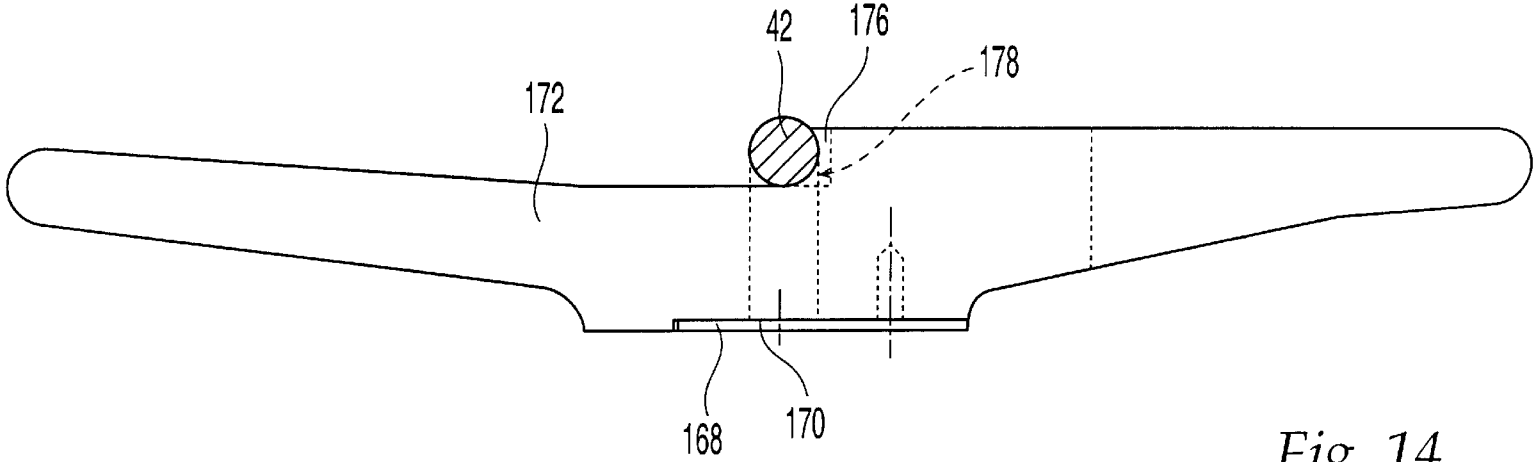
FIG. 14 is a side view of another embodiment with two locking members in a locking position.

The locking member 166 of the embodiment of FIGS. 13 and 14 includes two locking portions 168 and springs 170, which are preferably formed of a single stamped spring clip, attached to body 172. The locking member 166 is disposed in a recess 174 in the base of the body 172. The recess 174 is configured to allow the locking portions 168 to be displaced inwardly when the cleat component is inserted into the padeye, and the springs 170 resiliently bias the locking portions 168 radially with respect to the horns. A snap fit association is thus provided when the locking portions 168 move back out to their locking position shown, to secure the bale 48 between the locking portions 168 and the stop portion 176 of the body 172. To release the cleat component from the padeye, the locking portions 168 of the locking member 166 are displaced inwardly to allow the body 172 to be slid out of the bale 42.

As shown in FIG. 14, the protruding locking portions 168, and preferably the locking member 166 in general, are disposed vertically at the bottom of the base and are of relatively small vertical height. They are preferably located to prevent a line tied around the cleat and padeye combination from releasing the locking member 166 from the locking position.

Most preferably, the springs 170 and the locking portions 168 are configured such that a tool such as a screw driver is required to release the cleat component from the padeye. A recess 178 is provided open to the top of the cleat component, preferably within the stop portion, to receive such a tool and to permit prying the component from the bale 42. In an alternative embodiment, the stop is resiliently biased and can include an additional locking portion on the opposite side of the bale 42 from locking portions 168.

In each embodiment, the locking member preferably protrudes from the body in the locking position to enable the cleat component to be locked to a standard padeye with a uniform bale. Also, preferably the locking member is configured to permit mounting and locking of the body to the padeye while the locking member is mounted to the body. Also, preferably less than a full rotation of the locking member is required to lock the body to the padeye, in order to speed the attachment of body and padeye.

One of ordinary skill in the art can envision numerous variations and modifications. For example, a button may be employed to move the locking member from the unlocked to the locking position, or vice versa. All of these modifications are contemplated by the true spirit and scope of the following claims.

What is claimed is:

1. A cleat component, comprising:

a cleat body including first and second elongated cleat horns extending in substantially opposite directions; and a locking member attached to the body and protruding therefrom in a locking position;

wherein at least a receivable one of the body and the locking member is receivable in an opening in a bale of a padeye, and the locking member protrudes resiliently from the body by a distance sufficient to lock the body to the padeye when the receivable one is biased through the bale, for providing a cleat.

2. The component of claim 1, wherein both the first horn and the locking member are receivable through the bale in the locking position.

3. The component of claim 2, wherein the locking member includes at least one portion resiliently biased generally radially with respect to the first horn.

4. The component of claim 1, wherein the locking member is resiliently biased toward the locking position to lock the body to the padeye in snap-fit association therewith.

5. The component of claim 4, wherein the body includes a stop configured to prevent reception of the body in the bale past the stop.

6. The component of claim 1, wherein the locking member is mounted to the body for movement from an unlocked position to the locking position, the component being separable from the bale when the locking member is in the unlocked position.

7. The cleat component of claim 1, wherein the body is mountable to the bale and a second locking member is attached to the body and is lockable to the bale when the receivable one is received in the bale with the second locking member in the locking position, for providing a cleat.

8. The cleat component of claim 7, wherein the second locking member is positionable around a side of the bale in the locking position when the first horn is received through the bale.

9. A cleat component and padeye combination, comprising:

a padeye attachable to a mounting surface of a sailboat and including a bale defining a bale opening configured for receiving a line;

a cleat body including first and second elongated cleat horns extending in substantially opposite directions;

a locking member connected to the body and protruding therefrom in a locking position;

wherein at least a receivable one of the body and the locking member is receivable in the bale opening, and the body and the locking member are lockable to the bale when the receivable one is received in the bale with the locking member in the locking position, such that the component and the padeye provide a cleat.

10. The combination of claim 9, wherein the locking member is connected to the body movably from an unlocked position to the locking position.

11. The component of claim 9, wherein the body includes a base surface configured for limiting axial rotation of the body against a base of the padeye to which the bale is mounted.

12. The component of claim 9, wherein the locking member is fixable to the body in the locking position.

13. The component of claim 9, wherein the locking member is attached with the body in the unlocked position.

14. The cleat component and pad eye combination of claim 9, comprising:

a second locking member attached to the body and protruding therefrom in a locking position, wherein the first horn is receivable through the bale opening, and the body is mountable to the bale while the second locking member is attached to the body and is lockable to the bale when the receivable one is received in the bale with the second locking member in the locking position, for providing a cleat.

15. The cleat component and pad eye combination of claim 14, wherein the second locking member is positionable around a side of the bale in the locking position when the first horn is received through the bale.

16. A cleat component, comprising:

a cleat body including first and second elongated cleat horns extending in substantially opposite directions, the first horn being receivable in an opening in a bale of a padeye;

a stop connected to the body and protruding therefrom by an amount sufficient to prevent reception of the first horn in the bale past the stop; and a cleat base connected to the body and disposed beneath the second horn and having a wall for abutting a line tied around the component and the padeye between the horns and a surface to which the padeye is attached such that the line prevents removal of the first horn from the bale.

* * * * *